US005158483A

United States Patent [19]

Fishman et al.

[11] Patent Number: 5,158,483

[45] Date of Patent: Oct. 27, 1992

[54] ANTENNA CONNECTOR AND CONCEALED TEST JACK

[75] Inventors: Graham A. Fishman; Kenneth S. Temkin, both of Coral Springs, Fla.

[73] Assignee: Motorola, Inc., Schaumburg, Ill.

[21] Appl. No.: 285,286

[22] Filed: Dec. 15, 1988

Related U.S. Application Data

[63] Continuation of Ser. No. 141,813, Jan. 11, 1988, abandoned.

[51] Int. Cl.[5] ..... H01R 17/18

[52] U.S. Cl. ..... 439/668; 439/218; 439/916; 455/89

[58] Field of Search ..... 439/668, 669, 170–175, 439/177, 916, 189, 217, 218, 221, 222, 223; 455/89, 90

[56] References Cited

U.S. PATENT DOCUMENTS

| | | | |
|---|---|---|---|
| 2,909,615 | 10/1959 | Frantz | 439/188 |
| 3,474,382 | 10/1969 | Coon | 439/222 |
| 3,573,628 | 4/1971 | Cramer et al. | 343/702 |
| 3,946,390 | 3/1976 | Alexander et al. | 343/702 |
| 4,134,120 | 1/1979 | DeZoach et al. | 343/900 |
| 4,286,335 | 8/1981 | Eichler et al. | 343/702 |
| 4,398,784 | 8/1983 | Takihara | 439/188 |
| 4,435,713 | 3/1984 | Gasparaitis et al. | 343/702 |
| 4,463,358 | 7/1984 | Phillips | 439/217 |
| 4,537,453 | 8/1985 | Takeuchi | 439/217 |
| 4,539,439 | 9/1985 | Strothmann | 439/217 |
| 4,759,729 | 7/1988 | Kemppainen | 439/581 |

FOREIGN PATENT DOCUMENTS

| | | | |
|---|---|---|---|
| 0345492 | 3/1931 | United Kingdom | 439/217 |

*Primary Examiner*—David L. Pirlot
*Attorney, Agent, or Firm*—Pablo Meles

[57] ABSTRACT

Direct access to internal radio circuits is provided without requiring additional space on the radio housing to mount a test jack. The threaded aperture (104*a*) of a bushing (104) is aligned with an aperture (102*c*) in a radio housing (102). The bushing is attached to the radio housing and the base of an antenna (106) is inserted through the housing aperture and screwed into the bushing, thereby electrically connecting the antenna to the bushing. A printed circuit board (110) is attached to the housing. An electrically conductive spring (112) is held in contact with the bushing and provides an electrical connection between the printed circuit board and the bushing. A test jack (108) is mounted on the printed circuit board and is aligned with the apertures in the housing and bushing. When the antenna is removed, a test plug can be inserted through the apertures in the housing and bushing, and inserted into the jack, thereby providing a direct connection between external test equipment and the internal radio circuitry.

13 Claims, 1 Drawing Sheet

ANTENNA CONNECTOR AND CONCEALED TEST JACK

This is a continuation of application Ser. No. 07/141,813, filed Jan. 11, 1988, and now abandoned.

BACKGROUND OF THE INVENTION

This invention pertains to connectors, and more particularly to a combination antenna connector and test jack suitable for use in a portable radio housing.

Portable radio transceivers are usually equipped with an antenna connector and an R.F. test jack. The antenna connector typically includes a threaded aperture into which a threaded stud at the base of an antenna is inserted. To measure the performance of the radio, the test jack provides a direct connection between test equipment and the antenna port (i.e., the output of the transmitter in the transmit mode, or the input of the receiver in the receive mode) of the radio transceiver. The test jack typically includes a set of normally closed contacts that are connected between the antenna port and the antenna connector, such that the antenna is automatically disconnected when a plug is inserted into the test jack. Although the test jack can be mounted within the radio housing, this would undesirably require removal of the radio from the housing to connect test equipment to the test jack. Therefore, in addition to the antenna connector, the test jack is usually mounted on the exterior of the radio housing and is typically provided with a removable dust cap.

The recent trend in the portable radio market, however, has been towards phyiscally smaller radios. As radio designs become smaller and smaller, there is less space on the housing to position both the antenna connector and the test jack. Accordingly, the invention described below permits direct access to the test jack without requiring removal of the radio from its housing or the removal of a protective dust cap. More importantly, the present invention occupies no more space on the surface of the housing than is required for the antenna connector.

SUMMARY OF THE INVENTION

Briefly, the invention is an antenna connector and concealed test jack that includes a radio housing with an aperture. A bushing with a threaded aperture is connected to the housing such that the threaded aperture is aligned with the housing aperture. A jack is connected to the housing and aligned with the threaded aperture of the bushing. The antenna connector and test jack is constructed and arranged such that the base of an antenna can be inserted through the housing aperture and threaded into the bushing aperture. Provided the antenna is not positioned in the apertures, a plug can be inserted through both apertures and inserted into the jack.

In another embodiment, the invention also includes an electrically conductive spring clip in contact with the bushing.

DESCRIPTION OF THE PREFERRED EMBODIMENT

Figure 1:
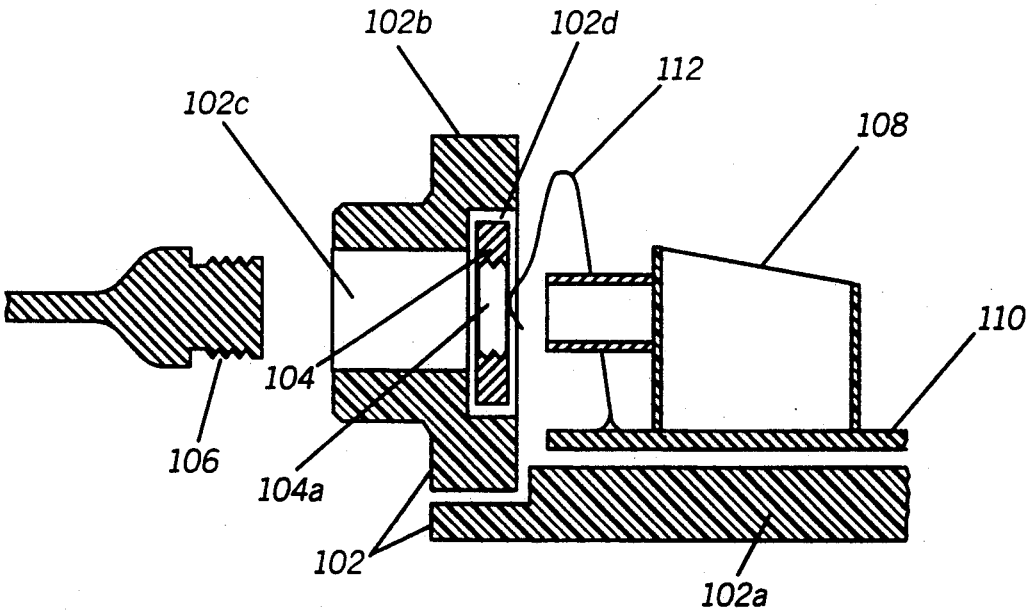
FIG. 1 is a cross sectional view of the antenna connector and concealed test jack.
Figure 2:
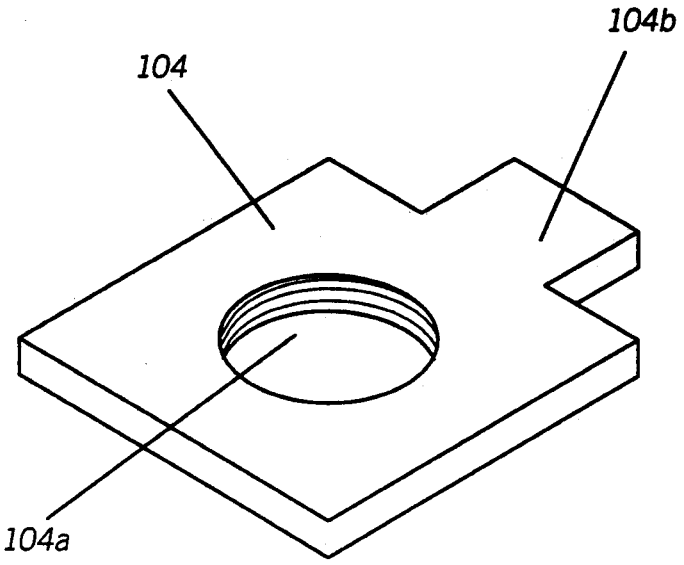
FIG. 2 is a perspective view of the bushing.

In FIG. 1, a cross sectional view of the antenna connector and concealed test jack is illustrated. Referring to this figure, a housing 102 includes a main portion 102*a* and a top portion 102*b* which attaches to the main portion. Housing 102 is preferably made from a plastic material that can be readily ultrasonically welded, such as polycarbonate. The top portion 102*b* of housing 102 includes an antenna aperture 102*c*. A bushing 104 having a threaded aperture 104*a* is positioned in a recess 102*d* on the inside of top housing portion 102*b*. Threaded aperture 104*a* is aligned with housing aperture 102*c*, that is, threaded aperture 104*a* is positioned over housing aperture 102*c* such that the base of an antenna 106 can be inserted through the housing aperture and then threaded into the bushing aperture. Bushing 104 is preferably made from stainless steel and is ultrasonically welded to top housing portion 102*a*. Bushing 104 also includes a spring contact tab 104*b*, as illustrated in the perspective view of FIG. 2.

A connector jack 108 is mounted on a circuit board 110, and the circuit board is attached to housing 102. (More specifically, circuit board 110 and housing top 102*b* attach to a non-illustrated rectangular frame, and the frame is inserted into and attached to main housing 102*a*.) Jack 108 is aligned with threaded aperture 104*a* and top housing aperture 102*c*, that is, the opening in the jack is positioned over the apertures such that a mating plug can be inserted through both apertures and then into the jack. Jack 108 is preferably a miniature, spring contact, circuit board mounted socket, such as a Singatron Enterprise P/N SJ-251-N. An electrically conductive spring clip 112 is attached to circuit board 110 and contacts tab 104*b*. Clip 112 is preferably made from beryllium copper.

Electrically, the antenna port (i.e., the output of the transmitter and the input of the receiver) of a radio transceiver is connected to jack 108. Jack 108 also includes a set of normally closed contacts. The antenna port is also connected to one of these contacts while the other contact is connected to clip 112. Clip 112 is electrically connected to tab 104*b* of bushing 104. Under normal operation, the base of an antenna 106 is inserted through top housing aperture 102*c* and then threaded into bushing aperture 104*a*. Thus, an electrical connection is formed from the antenna port of the radio transceiver, through the normally closed contacts of jack 108, to clip 112 and bushing 104, and, finally, to the base of antenna 106.

To test the radio transceiver, the antenna 106 is first removed from apertures 104*a* and 102*c*. Next, a mating plug (not illustrated) is inserted through both apertures 102*c* and 104*a*, and then into jack 108, thereby providing a direct connection between the antenna port of the radio transceiver and any test equipment that is connected to the mating plug. In addition, when the mating plug is inserted into the jack, the normally closed contacts in the jack are opened up, thereby disconnecting the antenna port of the transceiver from bushing 104. This prevents any short circuits that might result if the mating plug were to contact bushing 104.

We claim as our invention:

1. A connector assembly with associated first and second connectors, comprising:

first connecting means for receiving the first connector, said first connector comprises an antenna and said first connecting means having an aperture disposed therein;

second connecting means for receiving the second connector via said aperture, said first and second connecting means being constructed and arranged such that said first connector and said second connector may only be received by their respective connecting means when the other connector is not coupled to its connecting means.

2. The connector assembly with associated first and second connectors of claim 1, wherein said first connecting means has said aperture centrally disposed.

3. The connector assembly with associated first and second connectors of claim 1, wherein said first connecting means comprises a threaded member for receiving a threaded antenna.

4. The connector assembly with associated first and second connectors of claim 1, wherein said second connector and said second connecting means are removably pluggably connectable.

5. The connector assembly with associated first and second connectors of claim 1, wherein said second connecting means is arranged to be in alignment with said aperture of said first connecting means such that said second connector passes through said aperture to be received by said second connecting means.

6. A connector assembly with associated first and second connectors, comprising:

first connecting means for receiving and establishing an electrical connection with the first connector, said first connector comprises an antenna and said first connecting means having an aperture disposed therein;

second connecting means for receiving and establishing an electrical connection with the second connector via said aperture without establishing an electrical connection to said first connecting means, said first and second connecting means being constructed and arranged such that said first connector and said second connector may only be received by their respective connecting means when the other connector is not coupled to its connecting means.

7. The connector assembly with associated first and second connectors of claim 6, wherein said first connecting means has said aperture centrally disposed.

8. The connector assembly with associated first and second connectors of claim 6, wherein said first connecting means comprises a threaded member for receiving a threaded antenna.

9. The connector assembly with associated first and second connectors of claim 6, wherein said second connector and said second connecting means are removably pluggably connectable.

10. A connector assembly with associated first and second connectors, comprising:

first connecting means for receiving the first connector, said first connector comprises an antenna and said first connecting means having an aperture disposed therein;

second connecting means for receiving the second connector, said second connecting means being in direct linear alignment with said aperture of said first connecting means such that said second connector passes through said aperture to be received by said second connecting means;

said first and second connecting means being constructed and arranged such that said first connector and said second connector may only be received by their respective connecting means when the other connector is not coupled to its connecting means.

11. The connector assembly with associated first and second connectors of claim 10, wherein said first connecting means has said aperture centrally disposed.

12. The connector assembly with associated first and second connectors of claim 10, wherein said first connecting means comprises a threaded member for receiving a threaded antenna.

13. The connector assembly with associated first and second connectors of claim 10, wherein said second connector and said second connecting means are removably pluggably connectable.

* * * * *